US006158614A

United States Patent [19]

Haines et al.

[11] Patent Number: 6,158,614

[45] Date of Patent: Dec. 12, 2000

[54] WET WIPE DISPENSER WITH REFILL CARTRIDGE

[75] Inventors: Peter Haines, Skelmersdale; Peter Maddern, North Wales, both of United Kingdom; Donaghue R. Kelly, Atlanta, Ga.

[73] Assignee: Kimberly-Clark Worldwide, Inc., Neenah, Wis.

[21] Appl. No.: 08/902,999

[22] Filed: Jul. 30, 1997

[51] Int. Cl.[7] ..... B65H 16/00; B65D 83/00

[52] U.S. Cl. ..... 221/63; 221/33; 221/45; 221/46; 225/106

[58] Field of Search ..... 221/63, 33, 45, 221/46; 206/390, 409; 225/39, 77, 90, 106

[56] References Cited

U.S. PATENT DOCUMENTS

| | | | |
|---|---|---|---|
| D. 284,066 | 6/1986 | Civre | D9/339 |
| 3,749,296 | 7/1973 | Harrison | 225/106 |
| 3,795,355 | 3/1974 | Gerstein | 225/106 |
| 3,843,017 | 10/1974 | Harrison | 221/63 |
| 3,868,052 | 2/1975 | Rockefeller | 225/106 |
| 3,973,695 | 8/1976 | Ames | 221/63 |
| 4,009,682 | 3/1977 | Patel et al. | 118/118 |
| 4,101,026 | 7/1978 | Bonk | 206/205 |
| 4,171,047 | 10/1979 | Doyle et al. | 206/210 |
| 4,180,160 | 12/1979 | Ogawa et al. | 206/210 |
| 4,219,129 | 8/1980 | Sedgwick | 221/63 |
| 4,244,493 | 1/1981 | Harrison | 225/106 |
| 4,262,816 | 4/1981 | Margulies | 221/46 |
| 4,289,262 | 9/1981 | Finkelstein | 225/106 |
| 4,462,507 | 7/1984 | Margulies | 221/63 |
| 4,526,291 | 7/1985 | Margulies | 221/63 |
| 4,534,491 | 8/1985 | Norton et al. | 221/63 |
| 4,535,912 | 8/1985 | Bonk | 221/46 |
| 4,583,642 | 4/1986 | Blythe et al. | 206/390 |
| 4,651,895 | 3/1987 | Niske et al. | 221/63 |
| 4,848,575 | 7/1989 | Nakmura et al. | 206/449 |
| 4,863,027 | 9/1989 | Yano | 206/390 |
| 4,865,221 | 9/1989 | Jackson et al. | 221/48 |
| 5,076,424 | 12/1991 | Nakamura | 206/205 |
| 5,097,998 | 3/1992 | Shimasaki | 225/106 |
| 5,135,134 | 8/1992 | Dancy | 221/61 |
| 5,141,171 | 8/1992 | Yang | 242/55.54 |
| 5,246,137 | 9/1993 | Schutz et al. | 221/44 |
| 5,346,064 | 9/1994 | Rizzuto | 206/406 |
| 5,467,893 | 11/1995 | Landis, II et al. | 221/34 |
| 5,542,567 | 8/1996 | Julius | 221/63 |
| 5,542,568 | 8/1996 | Julius | 221/63 |
| 5,560,514 | 10/1996 | Frazier | 221/63 |
| 5,634,580 | 6/1997 | Levy | 225/56 |
| 5,718,353 | 2/1998 | Kanfer et al. | 221/63 |

FOREIGN PATENT DOCUMENTS

| | | | |
|---|---|---|---|
| 0006709 | 1/1980 | European Pat. Off. . | |
| 006 709 | 1/1980 | European Pat. Off. | 221/63 |
| 0117074 | 8/1984 | European Pat. Off. . | |
| 534600A2 | 3/1993 | European Pat. Off. . | |

*Primary Examiner*—Christopher P. Ellis
*Assistant Examiner*—Michael E. Butler
*Attorney, Agent, or Firm*—Nelson Mullins Riley & Scarborough

[57] ABSTRACT

A dispenser of wet wipes from a coreless log includes a semi-cylindrical chimney member in the lid of the container that houses the log or houses a refill cartridge in which the log is disposed. The chimney member is disposed and configured to shelter the main portion of a dispensing opening without sealing the dispensing opening. The chimney member influences the user to extract the wipe in a way that reduces the wasteful incidence of streaming of wipes from the log.

21 Claims, 9 Drawing Sheets

WET WIPE DISPENSER WITH REFILL CARTRIDGE

BACKGROUND OF THE INVENTION

The present invention relates to a dispenser for wet wipes and particularly to such dispenser that receives a refill cartridge containing such wipes in the form of a perforated, coreless log or accommodates such wipes in the form of a log without a refill cartridge.

Dispensing of wet wipes from conventional perforated, coreless logs is problematical. The typical design for a dispensing port for conventional coreless logs is a star-shaped dispensing hole disposed in a horizontal plane. The user has a natural tendency to withdraw the wipes vertically from this dispensing hole. However, if the user withdraws the wipes vertically from this dispensing hole design, the wipes tend to fail to separate along the perforations, and thus "streaming" results in withdrawal of several wipes one behind the other. This wastes the additional wipes beyond the one wipe that the user desired. To try to avoid streaming, the user must be instructed (as by printed instructions furnished on a printed label located near the hole) to pull the wipes sharply at a 45 degree angle. However, this action is not always successful in achieving separation along the first line of perforations and removing a single wipe. Moreover, the leading portion of next wipe to be dispensed, is partially exposed to the air and thus tends to dry out if not used immediately. This can lead to additional wastage. In one attempt to overcome streaming, the dispensing hole is made smaller. However, the wipes tend to get hung up in the hole and thus become difficult to dispense.

Conventional refill packs are made from flexible films produced in flowpack lines. The logs are dropped into the film sack. The liquid is inserted into the sack. It may be necessary to use special barrier films in order to resist permeation of solvents through the film. The sack is sealed with a heat weld to form a refill pack. The user must orient the pack in the dispenser according to the printed instructions on the flowpack with the correct end of the pack facing the dispensing hole and then break the film to start the first wipe. Installing such refill packs by the user is somewhat difficult and often time-consuming, and the welded seams may be prone to leakage. With any store of wipes imbued with liquid, the force of gravity tends to drain the liquid from the wipes and cause the drained liquid to collect at the bottom of the refill pack.

OBJECTS AND SUMMARY OF THE INVENTION

It is an object of the present invention to provide an improved wet wipe dispenser that receives refill cartridges and overcomes the problems noted above.

It also is an object of the present invention to provide an improved wet wipe dispenser that contains a coreless log of wipes without provision for refill cartridges and overcomes the problems noted above.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, the dispenser of the present invention desirably is used to contain and dispense wet wipes that are contained in a refill cartridge in the form of a coreless log that is divisible along a plurality of frangible lines. The dispenser may also be used to accommodate a coreless log that is placed directly in the dispenser rather than in a refill cartridge. The dispenser desirably functions so as to facilitate access to the wipes, to reduce the incidence of streaming and reduce evaporation of the moisture held by the next wipe to be dispensed. Moreover, in a dispenser according to the present invention, the refill cartridge is easily installed and readied for dispensing the first wipe out of the cartridge.

The dispenser includes a container that is configured with a bottom, a sidewall and a lid. The sidewall is tapered to facilitate nesting the containers during transportation. The container is typically configured to be easily manipulated in a single hand of the user, but also could be configured in larger sizes if desired.

A generally cylindrical chimney member is integral with the lid, which defines a dispensing opening having a main portion and an auxiliary portion contiguous with the main portion. The chimney member is configured with a side member and a hood that are configured and disposed to shelter the main portion of the dispensing opening without sealing the dispensing opening. The forward surface of the hood is angled, and the leading edge of the hood can be smooth, sharp or serrated. When the user makes a vertically oriented tug on the wipe, as is the natural tendency, the chimney member automatically guides the wipe partly forward at an acute angle from the vertical. This movement of the wipe guides the wipe away from a strictly vertical path as the wipe exits immediately from the dispensing opening. In so doing, the chimney prevents the wasteful streaming of multiple, unseparated wipes from the dispenser, as would occur if the wipe were to take a strictly vertical path immediately upon exiting the dispensing opening. Moreover, the slightly forward path enables the slotted openings in the auxiliary portion of the dispensing opening to engage the wipe and produce a drag, which in combination with the additional frictional force provided by passage of the wipe over the leading edge of the hood of the chimney member, results in separation of the wipe along the frangible line that divides contiguous wipes.

When not in use, the chimney member and dispensing opening are covered by a removable cap, which is substantially air tight and helps retain moisture in the next wipe to be dispensed.

The side and bottom of the refill cartridge are molded to conform to the shape of the interior compartment of the container and are configured so that the cartridge will only fit if properly oriented for use. The refill cartridge has a film cover, which has been sealed to the upper rim of the cartridge as by heat or otherwise and uses a heat seal layer that forms a barrier to the liquid formulation in the wipes. An "easy open" pull tab may be built into the film cover, either at the center or near the peripheral edge.

A wall bracket is configured to removably receive the container and is further configured to be mountable on a vertically extending wall.

The accompanying drawings, which are incorporated in and constitute a part of this specification, illustrate one embodiment of the invention and, together with the description, serve to explain the principles of the invention.

DETAILED DESCRIPTION OF THE PREFERRED EMBODIMENTS

Reference now will be made in detail to the presently preferred embodiments of the invention, one or more examples of which are illustrated in the accompanying drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. The same numerals are assigned to the same components throughout the drawings and description.

Figure 1:
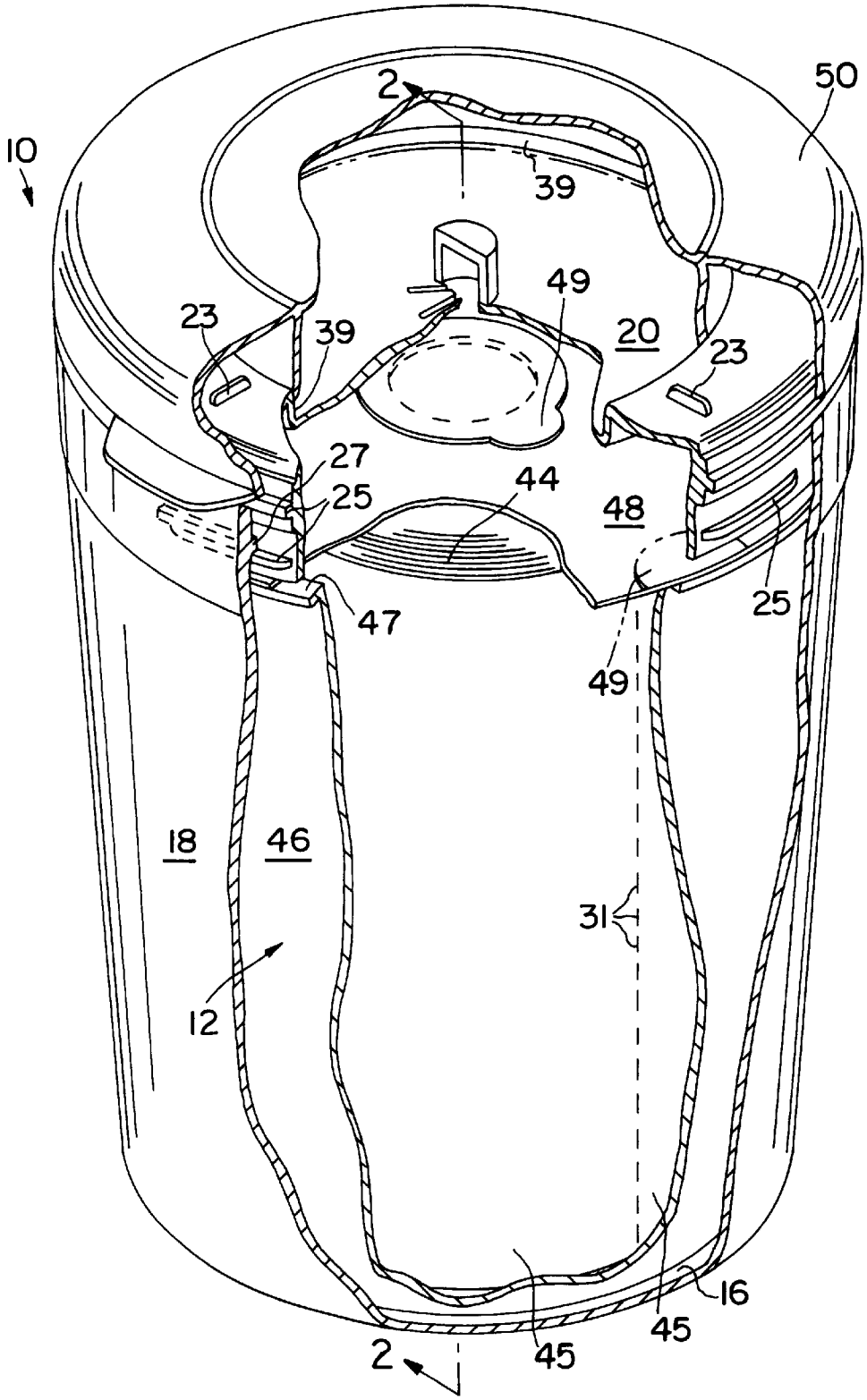
FIG. 1 is an elevated perspective view of a presently preferred embodiment of the invention, with portions cut away to reveal internal features that otherwise would be hidden in the view shown.

A presently preferred embodiment of the dispenser according to the present invention is shown in FIG. 1 and is represented generally by the numeral 10. Dispenser 10 is shown with a refill cartridge 12 installed.

Figure 2:
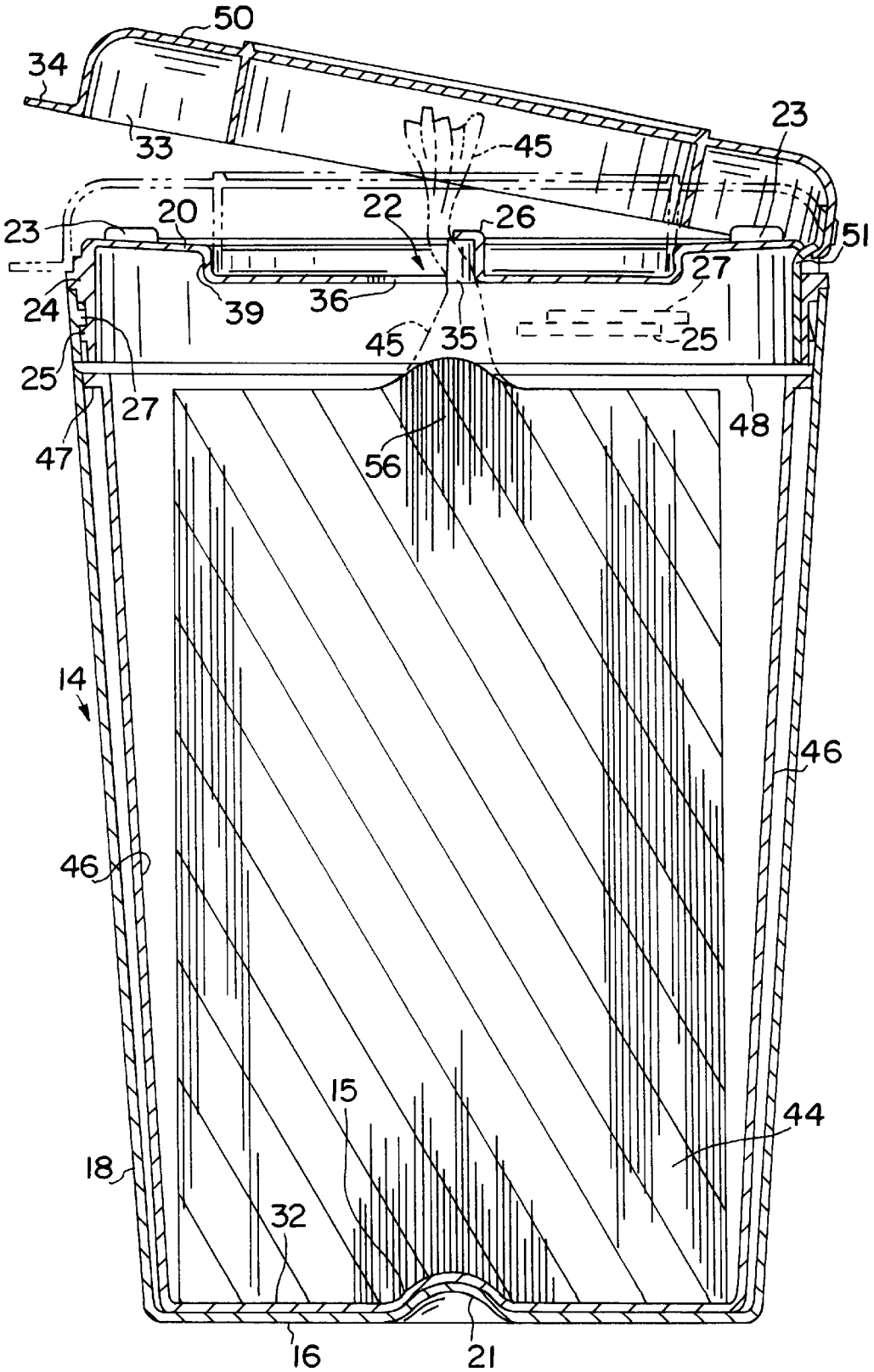
FIG. 2 is a cross-sectional view looking in the direction of arrows numbered 2—2 in FIG. 1.

As shown in FIG. 2, dispenser 10 includes a container, which is represented generally by the numeral 14. As shown in FIGS. 1 and 2, container 14 may be configured with a bottom 16, a sidewall 18, and a lid 20. A dome portion 21 is defined in bottom 16 and located generally centrally thereof. Sidewall 18 is connected to the periphery of bottom 16 and disposed generally perpendicular thereto. Lid 20 is removably connected to sidewall 18 and disposed generally opposite and parallel to bottom 16. Container 14 desirably is formed of rigid plastic material such as a low barrier commodity plastic such as low density polyethylene, high density polyethylene or polypropylene. However, barrier plastics or polyolefin plastics that have received a fluorination treatment, also could be used. Desirably, bottom 16 and sidewall 18 are integrally formed and in fact can be molded as a unitary structure.

As shown in FIG. 2, sidewall 18 has conical exterior and interior surfaces that are tapered to widen near the upper portion of sidewall 18. Thus, sidewall 18 tapers as one proceeds from lid 20 to bottom 16 of container 14. The tapering of sidewall 18 facilitates stacking one container inside another container to reduce the space requirements for transportation of same. The transverse cross-sectional shape of sidewall 18 can be circular, as in the embodiment illustrated in the Figs. or polygonal, as desired.

The outside surface of the container accommodates the branding and product details by printing or labeling. The inside surfaces of bottom member 16, sidewall 18, and lid 20 cooperate to define an interior compartment of container 14.

The lid may be screwed onto the container or snapfitted thereto. In the embodiment shown in FIGS. 1 and 2 for example, lid 20 has a depending flange 24 that has an outside surface configured with a plurality of circumferentially spaced apart ridges 25 for threadingly engaging corresponding slats 27 formed in the inside surface of the upper portion of sidewall 18. Ridges 25 and slats 27 cooperate to permit lid 20 to be screwed into the upper portion of sidewall 18. As shown in FIGS. 1 and 2 for example, finger lugs 23 are desirably applied to the top surface of the lid in order to provide a surface for the user to apply leverage to screw or unscrew lid 20 and sidewall 18.

Figure 4:
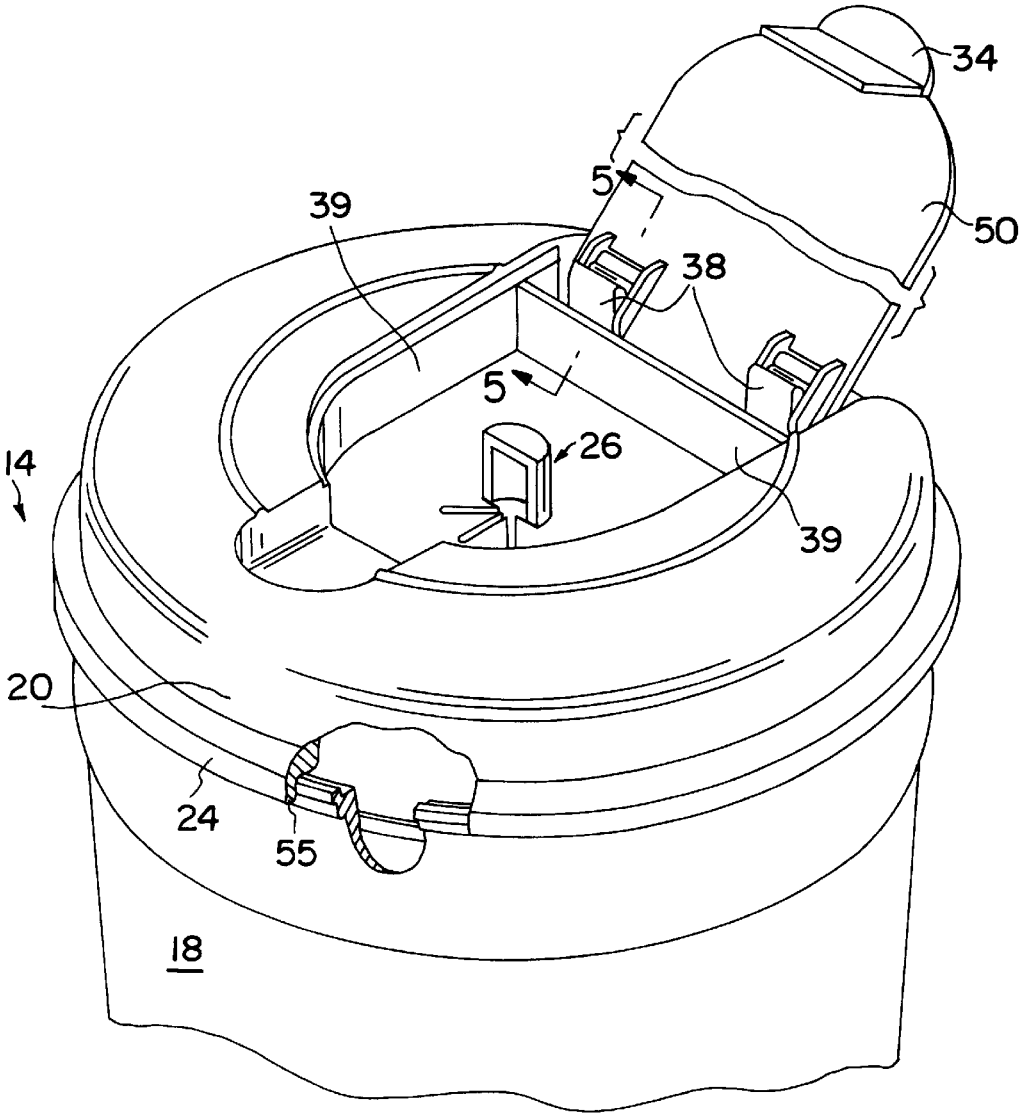
FIG. 4 is an elevated perspective view of a portion of an alternative embodiment of the invention, with certain portions cut away to reveal internal features that otherwise would be hidden in the view shown.

In the alternative embodiment shown in FIG. 4 for example, lid 20 has a depending flange 24. An annular bead 55 is formed on the inside surface of flange 24. The outside surface of the upper portion of sidewall 18 defines a corresponding annular lip 57 that engages bead 55 in a friction fit to permit lid 20 and sidewall 18 to be snap-fitted together to close container 14.

Figure 3:
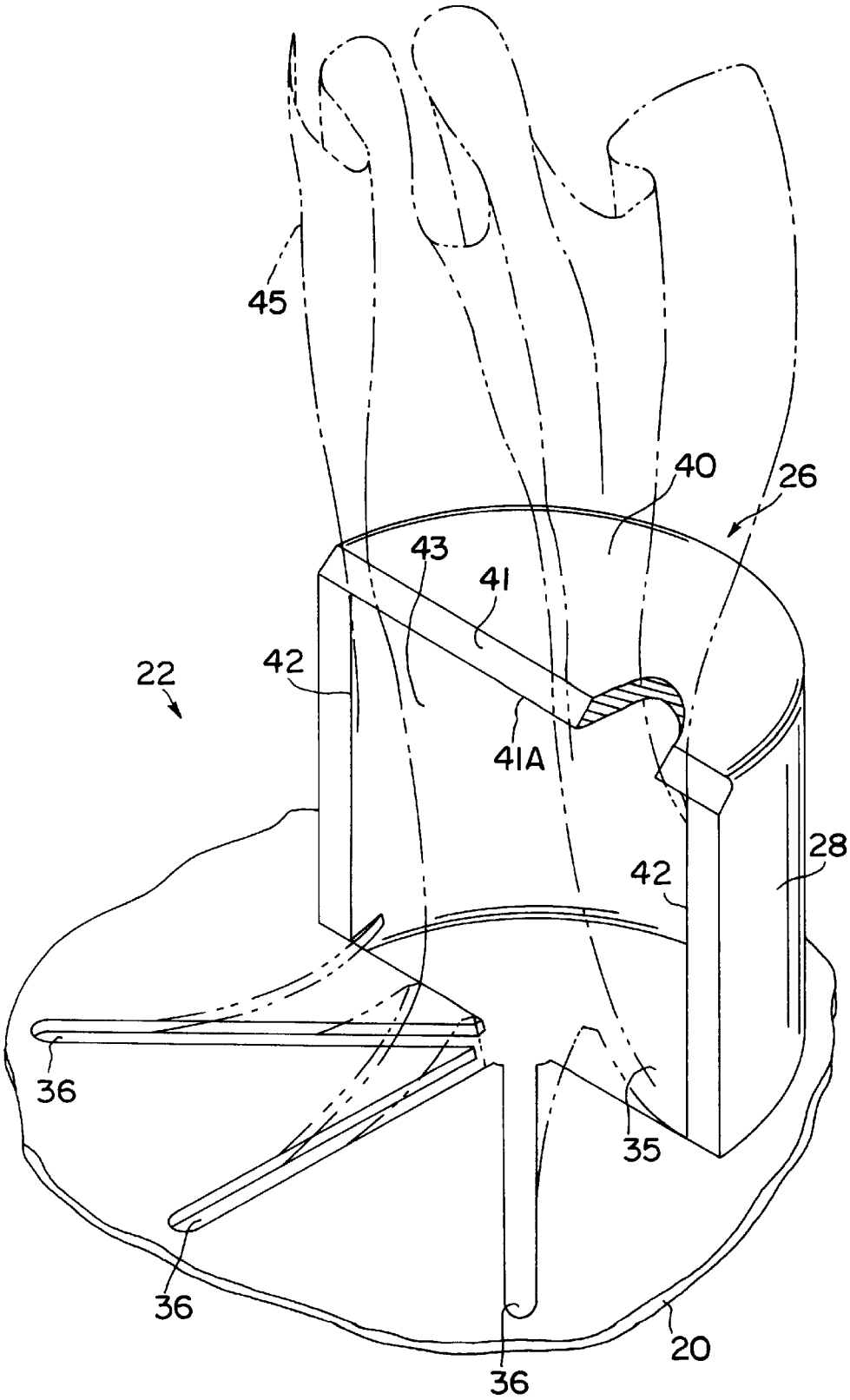
FIG. 3 is an enlarged, elevated perspective view, with a portion cut away, of components shown in FIGS. 1 and 2.

As shown in detail in FIG. 3 for example, lid 20 defines a dispensing opening therethrough that is indicated generally by the numeral 22. Dispensing opening 22 provides access from outside the dispenser to the interior compartment of the container. Dispensing opening 22 desirably is centrally located relative to the perimeter of lid 20.

Figure 3A:
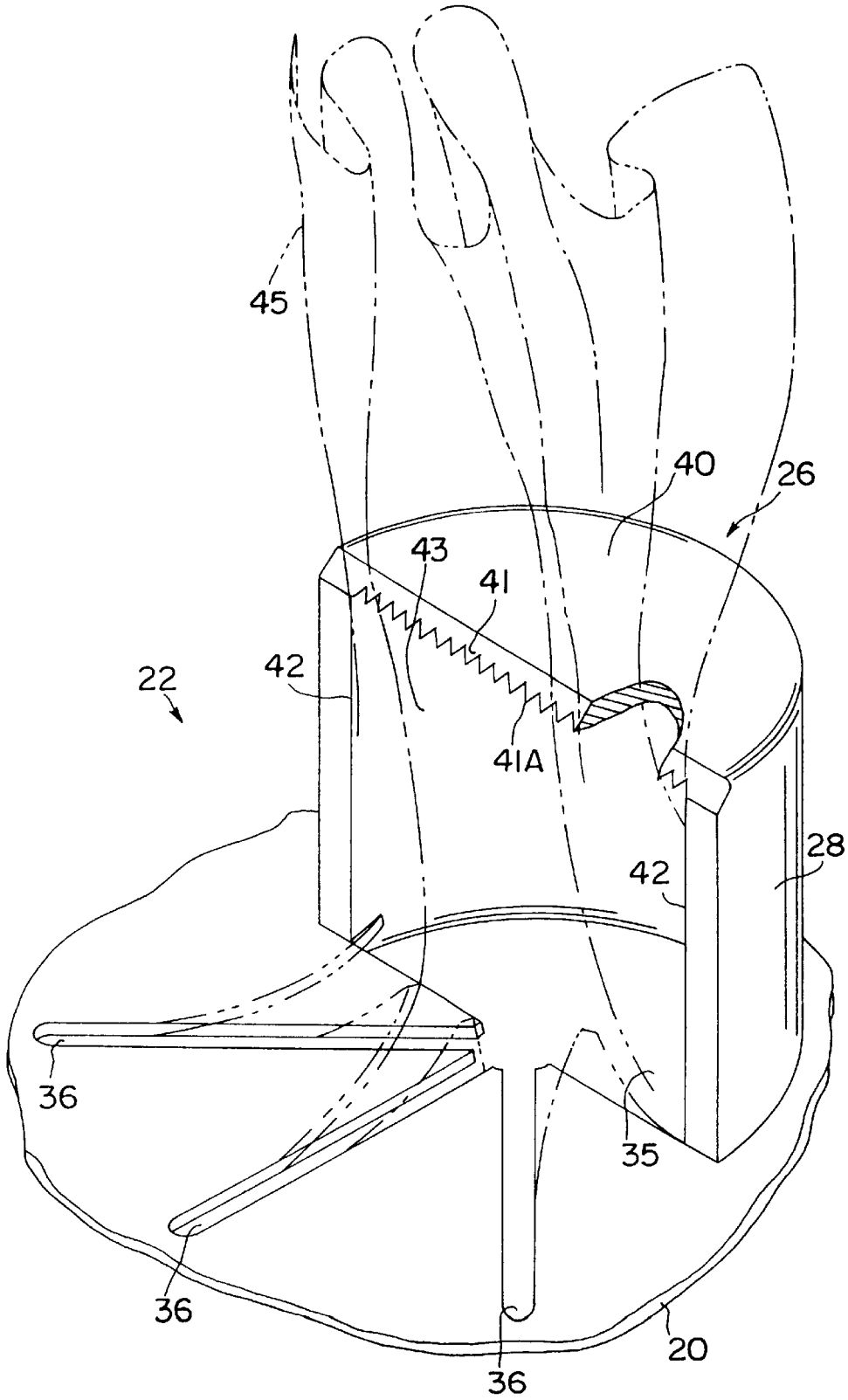
FIG. 3A is an enlarged, elevated perspective view, with a portion cut away, of an alternative embodiment of components shown in FIGS. 1 and 2.
Figure 3B:
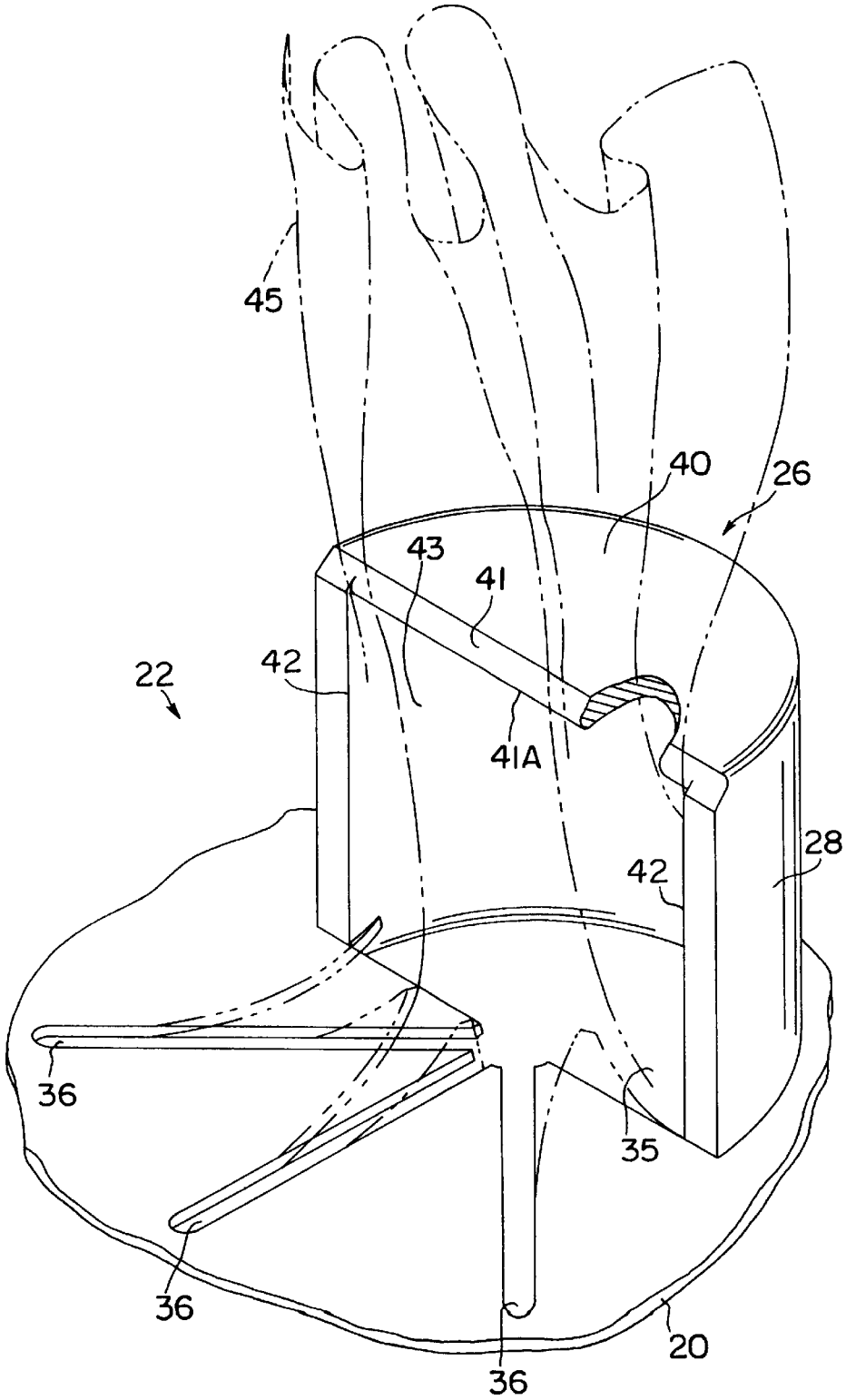
FIG. 3B is an enlarged, elevated perspective view, with a portion cut away, of another alternative embodiment of components shown in FIGS. 1 and 2.

In accordance with the present invention, and as shown in FIGS. 3, 3A, and 3B for example, dispensing opening 22 includes a main portion 35 and an auxiliary portion 36 contiguous with main portion 35. The auxiliary portion 36 of dispensing opening 22 defines at least one slotted opening 36 emanating generally radially from main portion 35 of dispensing opening 22. As shown in FIG. 3, three such slotted openings 36 are symmetrically disposed to emanate generally radially from main portion 35 of dispensing opening 22. However, two slotted openings 36 or more than three slotted openings 36 can form auxiliary portion of dispensing opening 22. Each slotted opening 36 is contiguous with main portion 35 of dispensing opening 22.

In accordance with the present invention, a semi-cylindrical chimney member is connected to the lid. As embodied herein and shown in FIGS. 3, 3A and 3B for example, a chimney member is generally designated by the numeral 26 and is integrally formed as part of lid 20. In the embodiment shown in FIGS. 3, 3A, 3B and 6 for example, chimney member 26 and lid 20 have been molded as a single component, and thus are formed as a unitary structure. In an alternative embodiment (not shown), the chimney member could be formed as part of a plug that could be press-fitted into a hole defined in lid 20 and thereby be rendered an integral structure.

As shown in FIGS. 1–4 and 6, chimney member 26 is configured and disposed to shelter main portion 35 of dispensing opening 22 without sealing the dispensing opening. As shown in FIGS. 3, 3A and 3B, chimney 26 includes a generally semi-cylindrical side member 28 that is connected to lid 20 and disposed generally normal to lid 20. Chimney member 26 further includes a hood 40 that is connected to side member 28 and disposed generally normal to side member 28 and parallel to the portion of lid 20 that defines dispensing opening 22.

Figure 6:
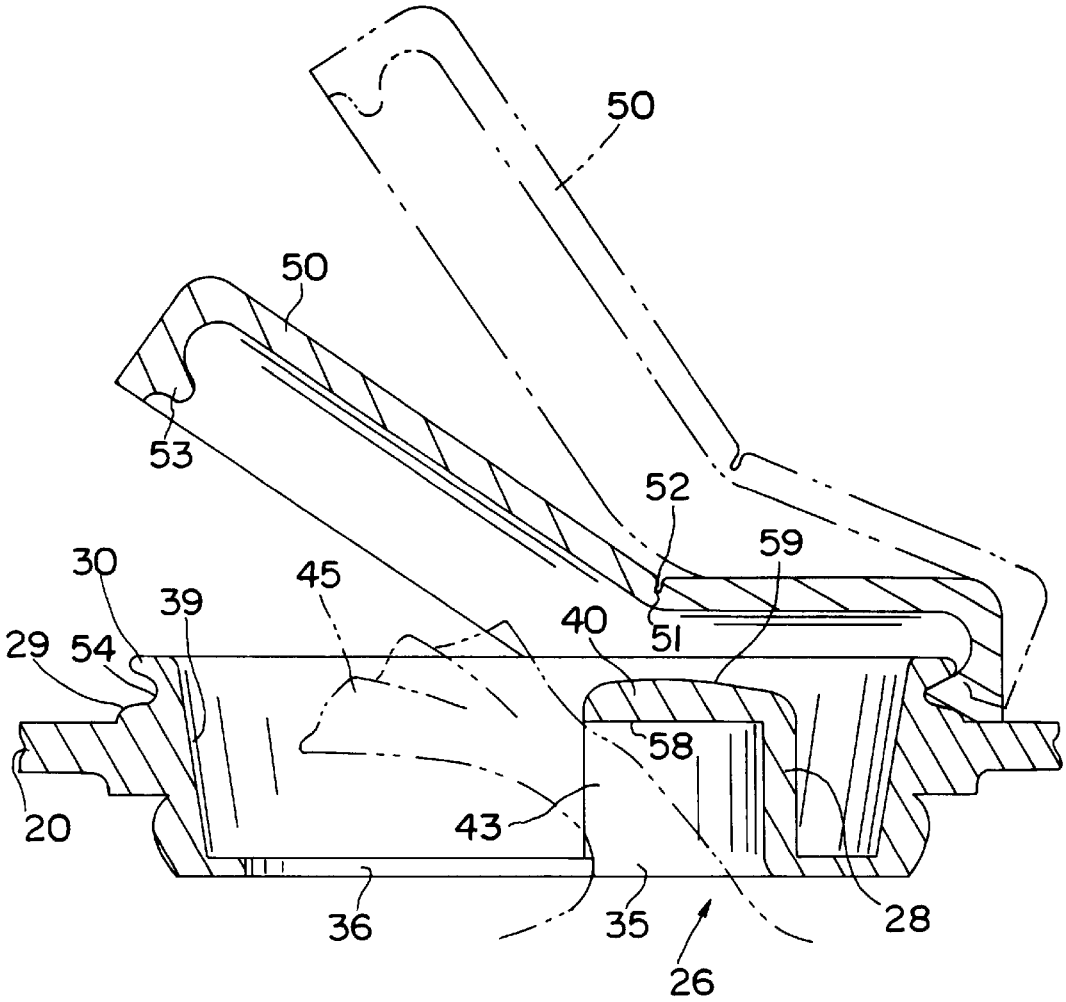
FIG. 6 is an exploded cross-sectional view of an alternative embodiment of a component of the present invention.

As shown in FIG. 6 for example, hood 40 is generally disposed in a plane that is parallel to the plane in which main portion 35 of dispensing opening 22 is disposed, and this is true of both the underside surface 58 and opposed topside surface 59 of hood 40. Hood 40 includes a lower forward free edge 41A. The inner free edges 42 of side member 28 cooperate with lower forward free edge 41A to define a passage 43 that communicates with main portion 35 of dispensing opening 22. A free forward side surface 41 of hood 40 is connected to underside surface 58 by lower forward free edge 41A of hood 40. Free forward side surface 41 of hood 40 is disposed at an angle of about 45 degrees from underside surface 58 of hood 40, but angles in the range of 30 to 60 degrees also would suffice. The lower forward edge 41A of free side surface 41 may be a continuous sharp edge as in FIG. 3, or sharp serrated edge as in FIG. 3A or smooth, i.e., slightly rounded, edge as in FIG. 3B.

As shown in FIG. 1 for example, dispenser 10 includes a cartridge 12 that is configured to be received in the interior compartment defined by container 14. An elongated web of nonwoven material is wound into a coreless roll or log 44 and disposed in cartridge 12. The web includes a plurality of frangible lines 31 for dividing the log 44 into individual wet wipes 45, which desirably are folded in half. The log 44 can be imbued with liquid.

As shown in FIG. 2 for example, cartridge 12 is formed by a rigid receptacle having a bottom 32 and sides 46, which terminate in a rim 47 that defines an open top. The side 46 and bottom 46 of the refill cartridge 12 are molded from a semi-rigid or rigid plastic material such as polyolefins or, if necessary, from a "barrier" plastic such as polyester or nylon. However, polyolefins plastics that have received a fluorination treatment, also could be used to form side 46 and bottom 32 of the refill cartridge 12.

Moreover, side 46 and bottom 32 of the refill cartridge 12 are configured so that cartridge 12 nests within the interior compartment of container 14. Desirably, bottom 32, side 46 and rim 47 are configured so that refill cartridge 12 only will fit into the interior compartment of container 14 if cartridge 12 is properly oriented for use. A raised portion 15 is defined in bottom 32 and located generally centrally thereof and configured to conform to dome portion 21 in bottom member 16 of container 14. The outside surface of the cartridge accommodates the opening instructions, branding and product details by printing or labeling.

Cartridge 12 further includes a removable cover 48 that is disposed to seal the open top and desirably formed of barrier film that is sealed to rim 47 by heat or other means such as ultrasonically, inductively, or energy in the radio-frequency portion of the spectrum. If the impregnant liquid is not permeating, then a non-barrier film could be used to form cover 48. If the impregnant liquid is highly permeating, then cover 48 desirably is formed as a laminate that includes a heat seal layer and a barrier layer such as one formed of silicon dioxide. Examples of a suitable heat seal layer include those films formed of polyethylene, copolymers of ethylene and propylene, a low melting polyester, or a polyethylene ionomer such as the one sold by Dupont under the trademark SURLYN. Cover 48 also could be formed of barrier laminates of polyester or nylon or laminates that include an aluminum foil barrier layer or other barrier materials. To a certain extent, the composition of the heat seal layer will be chosen to match the composition of rim 47 of cartridge 12 in order to facilitate the heat sealing of the two together.

As shown in FIG. 1 for example, a pull tab 49 is desirably built into cover 48 and configured so that it can be grasped by the user to expose a hole large enough to enable the user to grasp the first wipe to be dispensed.

Desirably, as shown in FIG. 2 for example, pull tab 49 removes only the central portion of cover 48 to expose the first wipe 45 (shown in dashed line) from the center portion of log 44. In an alternative embodiment (as shown in dashed line in FIG. 1), pull tab 49 can be disposed near rim 47 and enables the user to peel back and remove substantially the entire cover 48 from cartridge 12.

The same equipment that is used for dosing conventional canisters, can be used to fill cartridge 12, thereby permitting the cartridge to be filled faster than if filled with a conventional flowpack refill. Using a cartridge to refill the dispenser of the present invention is easier than a refill pack made from a flexible film produced on a flowpack line for example. Instead of ripping the film forming the pack, the user merely pulls on the tab 49. Moreover, refill cartridges made from barrier materials can eliminate the need for expensive fluorination of container 14 that otherwise might be needed to resist permeation of solvents such as terpenes and other penetrating solvents. In addition, the tapered configuration of the sidewall 18 and sides 46 of cartridge 12 helps ensure reliable orientation of the log 44 with respect to dispensing opening 22 when a new cartridge is used to refill dispenser 10.

As shown in FIG. 2, raised portion 15 (or dome portion 21 in an embodiment that does not include a cartridge) helps ensure reliable orientation of the log 44 with respect to dispensing opening 22 when a new cartridge is used to refill dispenser 10. Moreover, as shown in FIG. 2, raised portion 15 (or dome portion 21 in an embodiment that does not include a cartridge) pushes up the wipes 45 in the center region 56 of log 44 towards the hole in cover 48. This facilitates the user's access to the next wipe to be dispensed. Another advantage of raised portion 15 (or dome portion 21 in an embodiment that does not include a cartridge) is its tendency to direct any liquid that has drained from the log of wipes under the force of gravity and collected on the bottom 32 (or 16 in an embodiment that does not include a cartridge) away from the center of log 44 and toward the peripheral region of log 44 where the last of the wipes to be dispensed resides. This helps keep these last wipes imbued with the liquid.

As shown in FIGS. 1, 2, and 4–6, a perimeter wall 39 is configured and disposed to engage the portion of lid 20 that defines and surrounds dispensing opening 22. Perimeter wall 39 extends above the outer surface of lid 20 and is disposed generally normal thereto. As shown in FIG. 2 for example, hood 40 can be disposed above perimeter wall 39. In an alternative embodiment shown in FIGS. 4 and 6, perimeter wall 39 can be configured to extend above hood 40.

In accordance with the present invention, a cap is provided to cover the dispensing opening when the cap is disposed in a closed position. The cap is configured to be removable to an open position wherein the user has access to the dispensing opening to extract dispensed wet wipes. In the presently preferred embodiment shown in FIGS. 1 and 2 for example, the dispenser includes a cap 50 that covers dispensing opening 22 when disposed in a closed position, which is shown in FIG. 1 for example. As shown in FIG. 2, cap 50 is configured to be removable to an open position wherein dispensing opening 22 is accessible to the user for dispensing of wet wipes 45. The cap design may be a small-hinged flip top as shown in FIGS. 1 and 2, wherein cap 50 includes a peripheral rim 33 configured to engage lid 20 in a friction fit. A small flexible hinge 51 connects cap 50 to lid 20, and a lifting tab 34 is provided in the front of cap 50 disposed opposite hinge 51 for the user to grasp. Desirably, cap 50, lifting tab 34, hinge 51 and lid 20 are integrally formed and in fact can be molded as a unitary structure.

Figure 5:
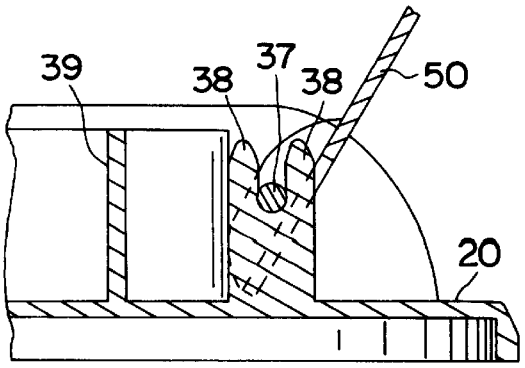
FIG. 5 is an exploded cross-sectional view of components shown in FIG. 4 looking in the direction of arrows numbered 5—5 in FIG. 4.

In another cap design shown in FIGS. 4 and 5, a wide-hinged flap closure forms cap 50. As shown in FIG. 5, the underside of cap 50 is configured to define at least one axle 37. Lid 20 is configured with opposed gripping arms 38 that form a bearing surface withing which axle 37 pivots to permit the user to move cap 50 between the open and closed positions.

A snap-fit configuration of cap 50 is illustrated in FIG. 6 and includes a hinge portion 51 formed by a score 52.

An annular-shaped rib 53 formed in the underside of cap 50 near the free edge thereof, is received in a friction fit into the receiving portion 54 formed in outer surface 29 of perimeter wall 39. The outline of cap 50 drawn in chain-dashed line in FIG. 6, illustrates a progressive orientation of cap 50 as cap 50 is removed to expose the dispensing opening. Chain-dashed line is also used in FIG. 6 to illustrate a free end of a wet wipe 45.

Figure 7:
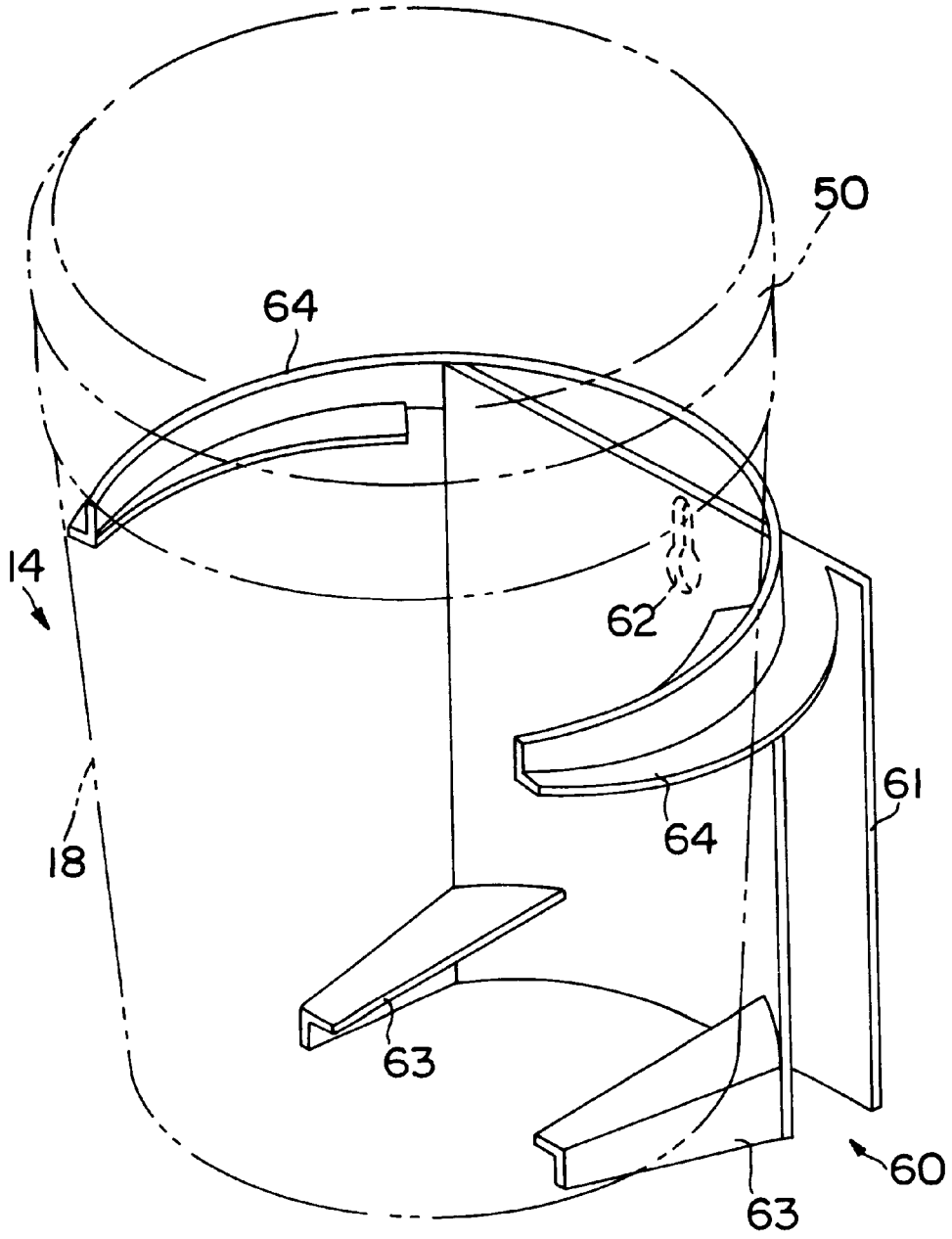
FIG. 7 is an elevated perspective view of an embodiment of a wall bracket component of the invention, configured to be used with the embodiment (shown in phantom) of the invention shown in FIGS. 1 and 2.
Figure 8:
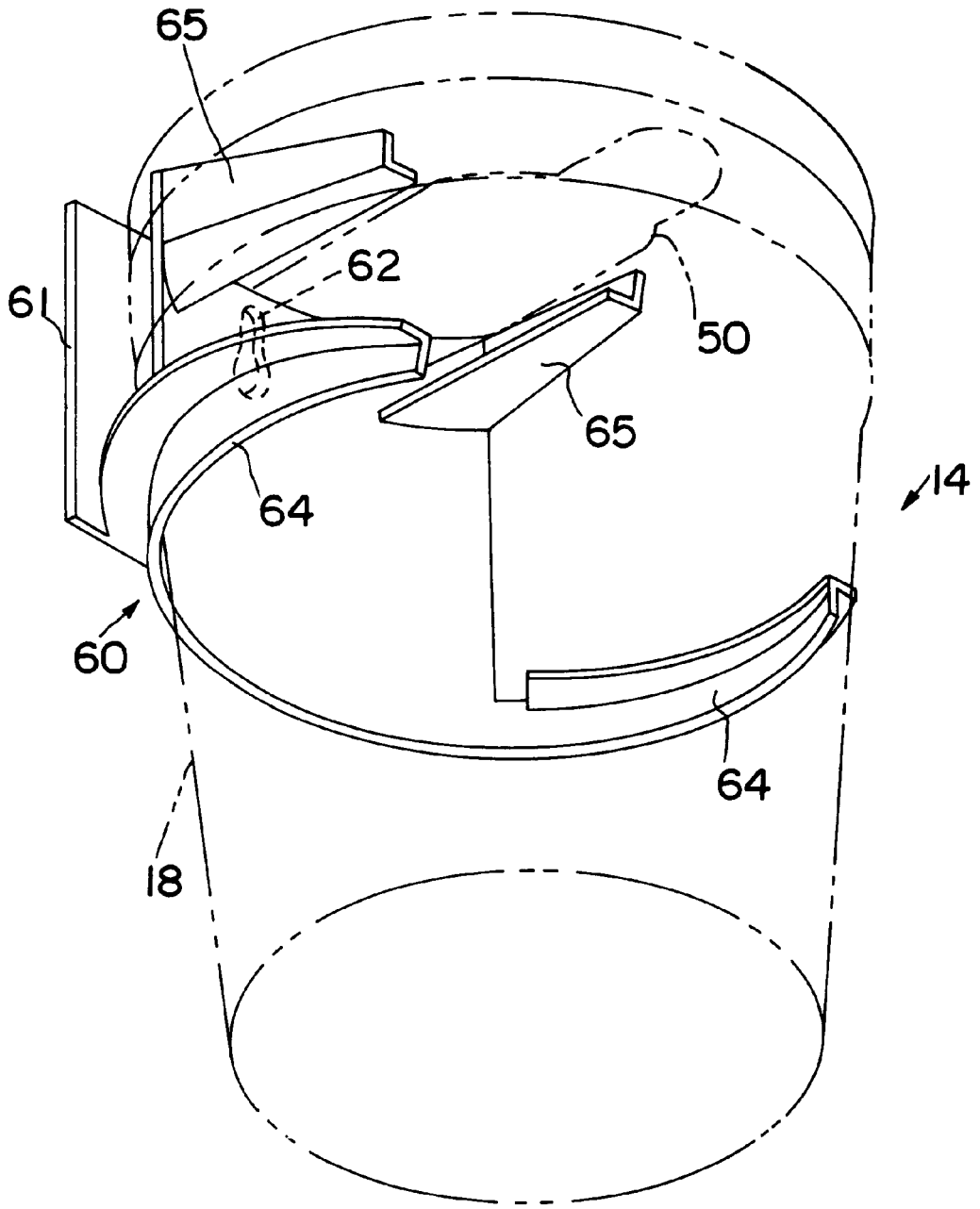
FIG. 8 is an elevated perspective view of an embodiment of a wall bracket component of the invention, configured to be used with the embodiment (shown in phantom) of the invention shown in FIGS. 4 and 5.

Another desirable component of the dispenser of the present invention is shown in two different embodiments in FIGS. 7 and 8. A wall bracket 60 is configured to removably receive container 14 (shown in phantom) and is further configured to be mountable on a vertically extending wall.

In the FIG. 7 embodiment, a wall plate 61 is provided with a mounting hole 62. A pair of base arms 63 allow the bottom of container 14 to rest thereon, while a spaced apart and opposed pair of gripping arms 64 are disposed near the top edge of wall plate 61 and engage the outside surface of sidewall 18 of container 14.

In the FIG. 8 embodiment, a wall plate 61 is provided with a mounting hole 62. A pair of gripping arms 64 are spaced apart to engage the outside surface of sidewall 18 of container 14, while a pair of upper arms 65 are disposed near the top edge of wall plate 61. Upper arms 65 are configured to be disposed to straddle each side of cap 50. Moreover, upper arms 65 are configured to be disposed to constrain the top surface of lid and thus prevent container 14 from tipping out of the grasp of gripping arms 64.

As shown in FIGS. 2 and 4 for example, chimney 26 is further configured so that passage 43 faces away from hinge 51 and gripping arms 38. With this configuration, in order to permit cap 50 to be opened, dispenser 10 will be oriented in wall bracket 60 so that hinge 51 and gripping arms 38 are disposed near the wall. Thus, when the user removes a wipe, the pulling motion on the wipe does not tend to pull dispenser 10 away from the wall mounting and out of the grasp of wall bracket 60.

In operation, when the user grabs the free end of wet wipe 45, the forward lower edge 41A of free side surface 41 of hood 40 of chimney member 26 forces the user's natural tendency to pull vertically, to alter the strictly vertical path traveled by the wipe immediately after exiting main portion 35 of dispensing opening 22. As shown in FIGS. 2 and 3, when the user makes a vertically oriented tug on wipe 45, the chimney member automatically guides wipe 45 partly forward at an acute angle from the vertical in order to pass through the passage 43 that is framed by forward lower edge 41A and the forward inside edges 42 of side member 28 of chimney member 26. This path of the wipe takes the wipe away from a strictly vertical route as the wipe exits immediately from main portion 35 of dispensing opening 22. In so doing, chimney member 26 prevents the wasteful streaming of multiple, unseparated wipes from the dispenser, as would occur if the wipe were to take a strictly vertical path immediately upon exiting dispensing opening 22. Moreover, the slightly forward path enables slotted openings 36 of auxiliary portion 36 of dispensing opening 22 to grab the wipe sufficiently such that in combination with the additional frictional force provided by the passage of the wipe over lower edge 41A, separation of the wipe along the frangible line that divides contiguous wipes is certain to occur. Thus, the edges of slotted openings 36 together with lower edge 41A act to ensure reliable separation of wipe 45 along the line of perforations 31 that form the frangible line separating wipe 45 from the next wipe in the log 44.

While a preferred embodiment of the invention has been described using specific terms, such description is for illustrative purposes only, and it is to be understood that changes and variations may be made without departing from the spirit or scope of the following claims. However the novelty of these components can be applied to other containers of moist sheet products as well.

What is claimed is:

1. A dispenser of a pre-moistened web that is divisible along a plurality of frangible lines into individual wet wipes, comprising:

a container defining an interior compartment, said container having a bottom, said container having at least one sidewall connected to said bottom, and said container having a lid connected to said sidewall and disposed generally opposite said bottom;

said lid defining a dispensing opening having a main portion and an auxiliary portion contiguous with said main portion; and a generally semi-cylindrical chimney member connected to said lid, said chimney member defining a passage communicating with said main portion of said dispensing opening, said chimney member being configured and disposed to shelter said main portion of said dispensing opening without sealing said dispensing opening, said chimney member comprising a hood configured and positioned to prevent said pre-moistened web from being dispensed in a strictly vertical path from said dispensing opening.

2. A dispenser as in claim 1, wherein said auxiliary portion of said dispensing opening defining at least one slotted opening emanating generally radially from said main portion of said dispensing opening.

3. A dispenser as in claim 1, wherein:

said chimney member includes a side member connected to said lid and disposed generally normal thereto, said hood of said chimney member being disposed generally normal to said side member, said hood and said side member having free edges that define said passage.

4. A dispenser as in claim 3, wherein said hood defines an underside surface and said main portion of said dispensing opening and said underside surface are disposed generally in parallel planes, said hood further defining a free side surface connected to said underside surface by said free edge that defines said passage, said free side surface forming an acute angle with said underside surface.

5. A dispenser as in claim 3, wherein said free edge of said hood forms a continuous sharp edge.

6. A dispenser as in claim 3, wherein said free edge of said hood is serrated.

7. A dispenser as in claim 3, wherein said free edge of said hood is rounded.

8. A dispenser as in claim 1, further comprising a perimeter wall configured and disposed normal to said lid and extending above said dispensing opening.

9. A dispenser as in claim 8, wherein:

said perimeter wall extends above said hood.

10. A dispenser as in claim 1, wherein:

said lid is removably connected to said sidewall.

11. A dispenser as in claim 1, further comprising:

a cap that covers said dispensing opening when disposed in a closed position, said cap being configured to be removable to an open position wherein said dispensing opening is open to dispense wet wipes.

12. A dispenser as in claim 11, further comprising:

a flexible hinge connecting said cap to said lid, said cap further defining a peripheral rim configured to engage said lid in a friction fit.

13. A dispenser as in claim 11, wherein said cap defines a flexible hinge defined by a score line, said cap further defining a peripheral rim having a rib configured to engage said lid.

14. A dispenser as in claim 1, wherein said lid is configured to define at least one axle and said cap is configured to pivot about said axle.

15. A dispenser as in claim 1, wherein said sidewall tapers from said lid to said bottom of said container.

16. A dispenser as in claim 1, further comprising:

a dome portion defined generally centrally in said bottom of said container.

17. A dispenser as in claim 16, further comprising:

a premoistened log disposed in said interior compartment, said log having one end with a central region resting on said dome portion, said log including a plurality of frangible lines for dividing said log into individual wet wipes, said log having another end opposite said one end and disposed toward said dispensing opening.

18. A dispenser as in claim 1, further comprising:

a cartridge configured to be received in said interior compartment; and a premoistened log disposed in said cartridge, said log including a plurality of frangible lines for dividing said log into individual wet wipes, said cartridge being disposed in said interior compartment to dispose one end of said log toward said dispensing opening.

19. A dispenser as in claim 18, wherein said cartridge is formed by a rigid receptacle having an open top, a removable cover disposed to seal said open top, and a pull tab connected to said cover and configured for being grasped and pulled by the user to remove said cover from said receptacle.

20. A dispenser as in claim 18, wherein said cartridge defines a bottom and said bottom further defines a raised portion situated generally centrally in said bottom of said cartridge, said log having one end with a central region resting on said raised portion, said log having another end opposite said one end and disposed toward said dispensing opening.

21. A dispenser as in claim 1, further comprising:

a wall bracket configured to removably receive said container and configured to be mountable on a vertically extending wall.

* * * * *